United States Patent [19]

Lazzaro

[11] 4,270,554

[45] Jun. 2, 1981

[54] HAIR FASTENER CLIP FOR HAIR ROLLER

[76] Inventor: Philip T. Lazzaro, 54 Manning St., Edison, N.J. 08817

[21] Appl. No.: 955,156

[22] Filed: Oct. 27, 1978

[51] Int. Cl.[3] ..... A45D 2/00

[52] U.S. Cl. ..... 132/40; 132/48 A

[58] Field of Search ..... 132/40–42, 132/9, 46, 48, 50

[56] References Cited

U.S. PATENT DOCUMENTS

| | | | |
|---|---|---|---|
| D. 133,785 | 9/1942 | Reynolds | 132/40 UX |
| 1,690,937 | 11/1928 | Larm | 132/40 |
| 3,289,680 | 12/1966 | Kubiak | 132/40 |
| 3,595,246 | 7/1971 | Rusnak | 132/40 |

*Primary Examiner*—G. E. McNeill

*Attorney, Agent, or Firm*—Frederick W. Padden

[57] ABSTRACT

A hair fastener clip for a hollow cylindrical hair roller is disclosed. The roller has a hollow interior defined by an inner cylindrical wall and an exterior wall defining a peripheral surface onto which hair is rolled. The fastener comprises a pair of spaced apart legs and a third leg shorter in length than the pair of legs. The third leg extends downward from the pair of legs for engaging the inner cylindrical wall of the hair roller while lower surfaces of the pair of legs clamp the rolled hair onto the hair roller. The third leg comprises a loop member extending downward from a piece bridging the pair of spaced apart legs, an inclined member extending upward from the loop member, and a terminating end member contiguous to the inclined member and extending downwardly away from the pair of legs. Structural features of the hair fastener clip include a planar handle extending downward from the bridging piece, a bobby pin formed by the pair of legs and bridging piece.

10 Claims, 6 Drawing Figures

HAIR FASTENER CLIP FOR HAIR ROLLER

TECHNICAL FIELD

This invention relates to hair fastener clips and, particularly, to a hair roller fastener clip having fingers, or legs, of different lengths and planar alignments for facilitating hair setting while reducing manual and visual operations during the fastener clamping of hair on the roller.

BACKGROUND ART

A variety of hair fastener clips including bobby pins, pin curl spring clips and other hair retaining devices are available in the prior art for use in setting hair. Special configurations of such devices are in widespread use as a device for clamping hair rolled onto hollow cylindrical hair rollers.

A recognized problem with the special configurations is that they require a number of time-consuming and awkward manual operations during the roller hair setting activity. For example, extra large and cumbersome bobby pins are frequently used for setting hair on rollers. A deficiency of such pins is that their fingers, or legs, must be spread open by skilled manipulations while holding the roller before the spread legs can embrace the hair and the roller in a clamping position. Another disadvantage is that a multiplicity of the special bobbypins are required for each hair roller in order to ensure that the rolled hair is firmly held in place for curling. Other hair fastener clips for rollers utilize complex spring mechanisms which have the disadvantages that they are costly in materials, fabrication and assembly.

DISCLOSURE OF THE INVENTION

The foregoing problem is solved and a technical advance is achieved by a hair fastener clip which reduces the number of manual and visual operations needed for clamping hair on a hollow cylindrical roller. Specifically, the hair fastener clip is equipped with a pair of spaced apart legs, or fingers, each of which has a respective surface for clamping hair rolled onto an exterior peripheral surface of a hair roller. This arrangement eliminates the prior art necessity for a plurality of bobbypins for each roller. The hair fastener clip includes a structural member for joining the spaced apart legs and fixing them in a substantially parallel relationship with respect to one another. No manual spreading of legs is required according to one embodiment of my invention. This is achieved by the provision of a third leg which is shorter in length than the other two. The third leg extends downwardly from the spaced apart legs for engaging an inner wall of the hollow cylindrical hair roller. The use of the third leg requires no manual spreading and virtually no visual sighting of the fastener clip for hair clamping operations.

It is a feature of this invention that the short length leg extends downwardly from the joining member at a location midway between the pair of spaced apart legs. The short length leg advantageously is a spring device having a loop member extending downward from the leg joining member, an extension from the loop member inclined upwardly toward the pair of spaced apart legs, and a terminating end member contiguous to the extension and extending downward away from the spaced apart legs.

Another feature of one embodiment of my invention is that the spaced apart legs and the joining member comprise a U-shaped unit having flat upper and lower surfaces and the loop member, extension and terminating end member of the third leg comprise flat upper and lower surfaces.

It is another feature of my invention that the pair of spaced apart legs comprise interior facing surfaces extending between first and second ends of the pair of legs and that those facing surfaces have an increasing spacing therebetween at the second ends of the legs for facilitating the clamping of hair on the roller.

A feature of the invention is the provision of a handle member dependent downwardly from the joining member. The handle is graspable for advancing and withdrawing the hair fastener clip from the rolled hair and hair roller with minimal interference due to the roller and rolled hair. A specific aspect of the handle arrangement is that the handle member is planar and inclined downwardly from an upper surface of the joining member.

Another embodiment of my invention is that the pair of spaced apart legs and the joining member form a bobby pin for embracing the rolled hair on the roller while the third leg springingly engages the inner cylindrical wall of the hair roller.

In the illustrative embodiments, the hair roller is suitably constructed of a plastic material and the hair fastener clip is a spring metal coated with a plastic or other protective coating.

DRAWING DESCRIPTION

DETAILED DESCRIPTION

Figure 1:
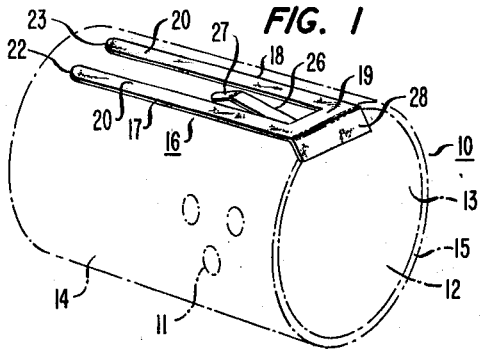
FIG. 1 is a perspective view of a hair roller cooperatively engaged with one embodiment of the hair retaining clip according to my invention.
Figure 2:
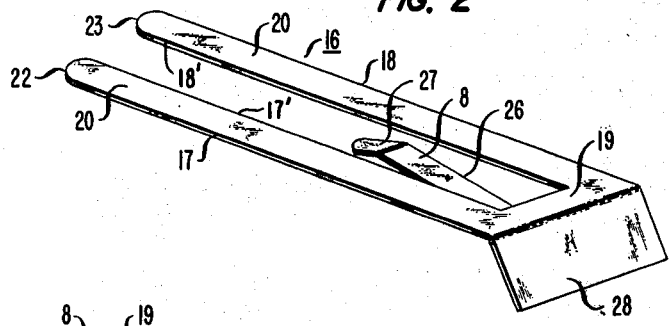
FIG. 2 is another perspective view of the hair retaining clip of FIG. 1, but without the roller.
Figure 3:
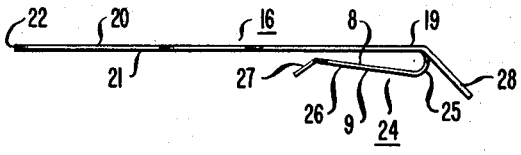
FIG. 3 is a side view of the clip of FIGS. 1 and 2.

A first embodiment of my invention shown in FIGS. 1, 2 and 3 functions with a hollow cylindrical hair roller 10 of FIG. 1 which may be constructed of any suitable material. Illustratively, the cylindrical roller 10 is made of a suitable plastic. Roller 10 advantageously is a unitary one-piece structure with a plurality of ventilating apertures 11 for promoting the drying of hair wound thereon. Roller 10 comprises a hollow interior 12 defined by an inner cylindrical wall 13. An exterior wall 14 of roller 10 defines a surface onto which hair (not shown) is rolled. Apertures 11 extend between walls 13 and 14. The thickness of roller 10 between walls 13 and 14 approximates the thickness of a side surface 15 of roller 10.

Figure 4:
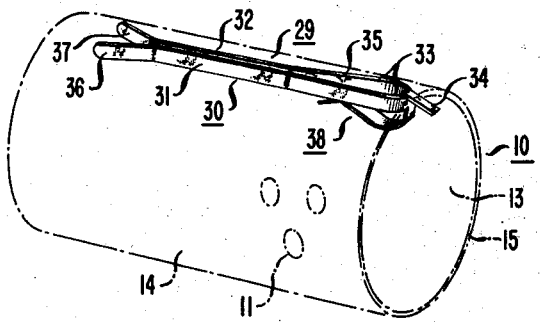
FIG. 4 shows a hair roller with another embodiment of the hair retaining clip according to my invention.

Essentially the same hair rollers are used in the embodiments of FIGS. 1 and 4. Accordingly, the same numbers are used in FIGS. 1 and 4 for identifying structural elements of the hair roller.

In FIGS. 1, 2 and 3, the first embodiment of my hair fastener clip is generally designated 16. It comprises a pair of outer fingers, or legs, 17 and 18 are joined together and held substantially fixed in a parallel relationship by a unitary bridging member 19. Legs 17 and 18 and member 19 have substantially flat upper and lower surfaces 20 and 21 in the illustrative embodiment. It is within the scope of my teaching to form these surfaces of rounded, curved, flat and/or combinations of those and other shapes. Outer ends 22 and 23 of legs 17 and 18 are curved or rounded to reduce hair snags and to facilitate the embracing of hair rolled onto roller 10. Each of the legs 17 and 18 have interior facing surfaces 17' and 18' extending substantially parallel to one another from a first, or inner, end nearby the bridging member 19 toward the second, or outer, ends 22 and 23 of the legs 17 and 18. At the second ends 22 and 23, the spacing between the facing surfaces 17' and 18' increases by virtue of the curved or rounded shape thereof.

Advantageously, hair clip 16 is equipped with an inner, or third, leg 24 which depends downwardly below the bridging member 19 and illustratively in a plane between and at a location midway between legs 17 and 18. Leg 24 is a unitary spring-like structure having flat upper and lower surfaces 8 and 9. Leg 24 is fastened contiguously to member 19. Leg 24 comprises a loop section 25 which arcuately extends from member 19 and an extension piece 26 which is inclined upwardly from section 25 and terminates in a downwardly extending end member 27 which facilitates advancement of the fastener 16 onto roller 10. The edge of member 27 is rounded or curved to prevent interference with and snags on roller 10.

Referring to FIGS. 1, 2 and 3, the legs 17 and 18 lie parallel to another and in a plane above the spring leg 24. Legs 17 and 18 function to embrace hair (not shown) rolled onto the upper exterior surface 14 of roller 10 while leg 24 functions to engage the lower interior surface 13 of roller 10. As depicted in FIGS. 1, 2 and 3, the length of the inner leg 24 is, by way of illustration, approximately one-half the length of each of the legs 17 and 18. This length relationship advantageously facilitates legs 17 and 18 engaging the rolled hair (not shown) against the lower surface 21 of clip 16 and the exterior surface 14 of roller 10 before leg 24 engages the interior wall 13. The downwardly extending end member 27 of leg 24 guides the engagement of the fastener 16 in a clamping manner with the rolled hair (not shown) and the roller 10 advantageously without having manually to retract or separate the legs 17, 18 and 24 and with minimal visual guiding by the user.

The hair clip 16 of FIGS. 1, 2 and 3 advantageously is further equipped with a handle extension 28 for ease in manipulating the clip onto and off of the rolled hair and hair roller 10. Extension 28 is formed out of the unitary structure of the bridging member 19. Handle 28 is bent downwardly dependent from member 19 illustratively at an approximate 45 degree angle. Projection of the handle 28 downward rather than upward or in a same plane with member 19 enables a relatively unencumbered and firm grasp of the handle by the hair setter without interference from the hair rolled on roller 10. The foregoing illustrative structural features of the roller 10 and fastener 16 facilitate manual dexterity in clamping wound hair on roller 10 and tend to speed hair setting operations.

The fabrication of the hair clip 16 illustrated in FIGS. 1, 2 and 3 suitably is by tool and die techniques operating on, by way of example, a flat piece of spring metal used for bobby pins of the prior art. Illustratively, a cut-out step of the U-shaped legs 17, 18 and bridging member 19 together with the inner leg 24 and handle 28 is executed. A next step includes the formation of the shape of the inner leg 24 and the angular bending of handle 28.

The manner in which the hair fastening device 16 serves its purpose in setting hair is now described by way of illustration with respect to FIGS. 1, 2 and 3. With the fastener 16 retracted from roller 10 as depicted in FIG. 2, a strand of hair is rolled onto the peripheral surface 14 of roller 10 and then the fastener 16 is advanced into a hair and roller 10 engaging position shown in FIG. 1 to clamp the rolled strand of hair to roller 10. A hair setter grasps fastener 16 by its handle 28 and advances legs 17 and 18 over the strand of hair rolled on the peripheral surface 14 of roller 10. Advantageously, the hair setter does not need to use fingers of two hands to separate any of the fingers, or legs, of the fastener 16 and can advance the fastener onto the hair and the roller 10 with essentially two or three fingers of one hand while holding the rolled hair and roller 10 with the other hand. As the fastener 16 is advanced, the end member 27 engages the inner peripheral wall 13 of roller 10 and guidedly spreads the inner leg 24 away from legs 17 and 18 until the fastener 16 is fully advanced onto the rolled hair and roller 10. At that point, the loop member 25 abuts the side surface 15 of roller 10 and acts as a stop whereby the fastener 16 and roller 10 assume a hair clamping position in relation to one another as illustrated in FIG. 1. Retraction of the fastener 16 from roller 10 after the hair setting procedure involves grasping handle 28 and removing it from roller 10 along its longitudinal axis.

Figure 5:
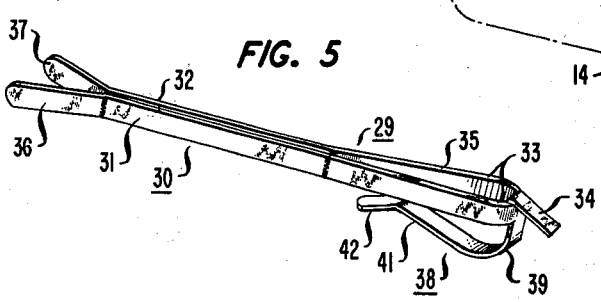
FIG. 5 illustrates in perspective the clip of FIG. 4.
Figure 6:
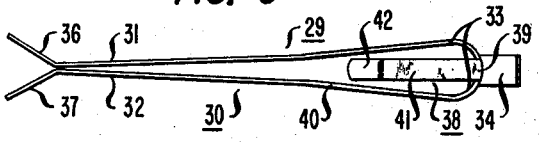
FIG. 6 depicts a bottom plan view of the clip of FIGS. 4 and 5.

In the embodiment of the invention shown in FIGS. 4, 5 and 6, a fastener device 29 including a bobby pin 30 is disclosed. Pin 30 has a pair of fingers, or legs, 31 and 32 interconnected by a loop 33 to which is attached a handle 34. Illustratively, handle 34 is affixed to an upper surface 35 of loop 33 and is angularly bent downward therefrom. Each of the legs 31 and 32 is equipped with a respective end member 36 and 37 which is bent outwardly away from its respective leg 31 and 32 to facilitate movement of legs 31 and 32 onto a strand of hair. Extremities of end members 36 and 37 are rounded to minimize hair snags.

Advantageously, the fastener structure 29 is equipped with a leg 38 which functions clampingly to engage the inner wall 13 of the hair roller 10 of FIG. 4. Leg 38 comprises a loop section 39 joined to a lower surface 40 of FIG. 6 and a member 41 which inclinely extends upward from loop 39 toward legs 31 and 32 and terminates in a bent extension 42 which projects downwardly away from legs 31 and 32 to facilitate insertion of the fastener 29 onto roller 10.

The manner in which the fastener 29 functions in a hair setting operation is now described with respect to FIGS. 4, 5 and 6. With the fastener 29 retracted from the roller 10 as shown in FIG. 5, a strand of hair is rolled onto the peripheral surface 14 of roller 10 and then end members 36 and 37 of the bobby pin 30 are movingly separated by hand for engaging a segment of the rolled hair between legs 31 and 32 of pin 30. As the rolled hair is embraced between legs 31 and 32 and the fastener 29 is advanced onto the roller 10, the rolled hair is clamped against the peripheral surface 14 of roller 10 illustratively by the entire lower surface 40 of loop 33, legs 31 and 32, and the members 36 and 37. A hair setter grasps fastener 29 by its handle 34 and advances legs 31 and 32 over the strand of rolled hair on the peripheral surface 14 of roller 10. As the fastener 29 is advanced, the end member 42 engages the inner peripheral wall 13 of roller 10 and guidedly spreads the leg 38 away from the bobby pin 30 until the fastener 29 is fully advanced onto the rolled hair and roller 10. At that point, the loop 39 abuts the side surface 15 of roller 10 and acts as a stop whereby fastener 29 and roller 10 assume a hair clamping position in relation to one another as illustrated in FIG. 4. Retraction of the fastener 29 from roller 10 involves grasping handle 34 and urging it from roller 10.

It is to be understood that the hereinbefore described arrangements are illustrative of the principles of my invention. In light of this teaching, it is apparent that numerous other arrangements may be devised by those skilled in the art without departing from the spirit and scope of the invention.

What is claimed is:

1. An arrangement for forming a curl in a head of hair comprising:

a hollow cylindrical hair roller (10) having a hollow interior (12) defined by an inner wall (13) and an exterior wall (14) defining a surface onto which hair is rolled, and means for clamping the hair rolled on said exterior surface wall (14) onto said roller, characterized in that said clamping means (16, 29) comprises a pair of spaced apart legs (17, 18 and 31, 32) each having a first end, a second end and a surface (21, 40) between said first and second ends for clamping said rolled hair on said exterior surface wall (14), said pair of legs comprising interior facing surfaces (17', 18') extending between said first and second ends of said legs and having an increasing spacing between said facing surfaces (17', 18') at said second ends of said legs, a member (19,33) joining said legs (17, 18 and 31, 32) together at the first ends thereof, and another leg (24, 38) shorter in length than said pair of legs and extending downwardly from said pair of legs and in a plane therebetween for engaging said inner wall (13) of said hair roller (10).

2. The arrangement of claim 1 further characterized in that said other leg (24, 38) depends downwardly from said joining member (19, 33).

3. The arrangement of claim 2 further characterized in that said other leg (24, 38) depends downwardly from said joining member (19, 33) at a location midway between said pair of spaced apart legs.

4. The arrangement of claim 2 further characterized in that said other leg (24, 38) comprises a loop member (25, 39) inclined upward toward said pair of spaced apart legs (17, 18 and 31, 32), and a terminating end member (27, 42) contiguous to said extension (26, 41) and extending downward away from said spaced apart legs.

5. The arrangement of claim 4 further characterized in that said pair of spaced apart legs (17, 18) and said joining member (19) comprise a U-shaped unit having flat upper and lower surfaces (20, 21), and said loop member (25), extension (26) and terminating end member (27) comprise flat upper and lower surfaces (8, 9).

6. The arrangement of claim 4 further characterized in that said clamping means further comprises a handle member (28, 34) dependent downwardly from said joining member (19, 33).

7. The arrangement of claim 6 further characterized in that said joining member (33) comprises an upper surface (35), and said handle member (34) comprises a planar handle inclined downwardly from said upper surface (35) of said joining member (33).

8. The arrangement of claim 4 further characterized in that said pair of spaced apart legs (31, 32) and said joining means (33) form a bobby pin (30) for embracing said rolled hair on said roller (10).

9. A hair fastener clip for a hollow cylindrical hair roller having a hollow interior defined by an inner cylindrical wall and an exterior wall defining a surface onto which hair is rolled, said fastener clip suitable for use in clamping the hair rolled on said exterior surface wall onto said roller, characterized by said fastener clip comprising a pair of spaced apart legs, means bridging said legs, said legs being fixed substantially parallel to one another by said bridging means, and each of said legs having a first end, a second end and a respective surface between said first and second ends for clamping said rolled hair on said exterior surface wall of said roller, said pair of legs comprising interior facing surfaces extending between said first and second ends of said legs and having an increasing spacing between said facing surfaces at said second ends of said legs, said bridging means bridging said legs at said first ends thereof, and another leg shorter in length than said pair of legs and extending downwardly from said bridging means in a plane between said pair of legs for engaging said inner cylindrical wall of said hair roller.

10. The hair fastener clip (16) of claim 9 further characterized in that said legs (17, 18) and said bridging means (19) have unitary, flat upper and lower surfaces (8, 9), said other leg (24) extends downwardly from said bridging means (19) in a plane midway between said pair of legs (17, 18), said other leg (24) comprises a loop member (25) extending downwardly from said bridging means (19), an extension (26) from said loop member (25) and inclined upwardly toward said legs (17, 18) and a terminating end member (27) contiguous to said extension (26) and extending downwardly away from said spaced apart legs (17, 18), said loop member (25), extension (26) and terminating end member (27) comprise flat upper and lower surfaces (8, 9), and said fastener clip (16) further comprising a planar handle member (28) depending downwardly from said bridging means (19).

* * * * *